US005649890A

United States Patent [19]

Lapp et al.

[11] Patent Number: 5,649,890

[45] Date of Patent: Jul. 22, 1997

[54] DRAW ROLLER FOR THE TRANSPORT OF A MATERIAL WEB, PARTICULARLY A PAPER WEB IN A WEB-FED PRINTING MACHINE

[75] Inventors: Joachim Alfred Lapp; Alfred Walter Weiler, both of Margetshöchheim, Germany

[73] Assignee: De La Rue Giori, S.A., Lausanne, Switzerland

[21] Appl. No.: 432,819

[22] Filed: May 2, 1995

[30] Foreign Application Priority Data

May 11, 1994 [CH] Switzerland ..... 1472/94

[51] Int. Cl.[6] ..... B23P 15/00

[52] U.S. Cl. ..... 492/20; 492/18; 492/33; 492/36

[58] Field of Search ..... 492/17, 18, 20, 492/30, 33, 35, 36

[56] References Cited

U.S. PATENT DOCUMENTS

| | | | |
|---|---|---|---|
| 1,175,940 | 3/1916 | Farnsworth et al. | 492/33 |
| 1,627,966 | 5/1927 | Goodlett | 492/33 |
| 2,900,024 | 8/1959 | Holcroft . | |
| 3,273,492 | 9/1966 | Justus | 492/20 |
| 3,942,735 | 3/1976 | Marchio et al. . | |
| 4,073,679 | 2/1978 | Schiel | 492/20 |
| 4,559,106 | 12/1985 | Skyttä | 492/30 |
| 4,998,333 | 3/1991 | Skyttä | 492/20 |
| 5,188,273 | 2/1993 | Schmoock | 492/30 |

FOREIGN PATENT DOCUMENTS

| | | |
|---|---|---|
| 0415882 | 3/1991 | European Pat. Off. . |
| 411044 | 3/1924 | Germany . |
| 1625615 | 1/1971 | Germany . |
| 4239640 | 7/1993 | Germany . |
| 492143 | 2/1938 | United Kingdom . |

*Primary Examiner*—Irene Cuda

*Attorney, Agent, or Firm*—Kane, Dalsimer, Sullivan, Kurucz, Levy, Eisele and Richard, LLP

[57] ABSTRACT

The draw roller is designed as a suction roller with a rotatable roller casing having orifices, and the material web loops around the draw roller along a circumferential portion. The internal suction-air supply connectable to a negative-pressure source opens out on the inner circumference of the roller casing and is designed so that a stationary suction surface of wedge-shaped form is obtained on the casing circumference. The wedge tip is directed opposite to the direction of rotation of the roller casing and is located at the start of said circumference portion in the roller center. The suction surface widens obliquely outwards on both sides with an increasing looping angle and, at the end of the circumferential portion, has a width corresponding to the total width of the material web.

5 Claims, 3 Drawing Sheets

DRAW ROLLER FOR THE TRANSPORT OF A MATERIAL WEB, PARTICULARLY A PAPER WEB IN A WEB-FED PRINTING MACHINE

FIELD OF THE INVENTION

The invention relates to a draw roller in the form of a suction roller for the transport of a material .web, particularly a paper web in a web-fed printing machine.

PRIOR ART

A draw roller of this type, designed as a suction roller, is known from EP-A-0,415,882. Compared with a conventional draw roller which has to cooperate with a pressure roller in order to achieve a slip-free transport of the material web, a driven suction roller has the advantage that only one side of the material web is loaded during transport and that the masses of a single suction roller which are to be accelerated or braked during changes in the transport speed are lower than those of a pair of rollers nipping the material web. These benefits carry weight particularly in the case of web-fed printing machines with a paper transport controllable by so-called pilgrim stepping, as described in said EP-A-0,415,882.

Web-fed printing machines set up for pilgrim-step operation work with printing units designed in the manner of sheet-fed printing units, in which the cylinders forming the nip have printing zones separated by cylinder pits. In order to prevent unprinted white strips from occurring on the paper web when it passes through the cylinder pits, the paper web is transported at a continuous speed only upstream and downstream of each printing unit and, during a printing operation, when it passes the printing zones of the two cylinders. Whereas, when it passes a cylinder pit, that is to say in the free non-nipped state, it is braked by the draw rollers designed as suction rollers, drawn back and accelerated again, in such a way that, when it passes the next printing zone, the paper web once again runs synchronously with the cylinders. As a result, not only can the printing images be printed onto the paper web virtually without any interruption at a predetermined narrow spacing for the purpose of saving paper, but also printing images of variable length can be produced, individual register corrections made for each individual print and the repetition length of the individual prints varied irrespective of the length of the printing images. So that the speed changes, which are rapid for pilgrim-step operation of this type, can be imparted with high accelerations to the paper web, two light-weight suction rollers serve for the transport of the paper web. These rollers are installed upstream and downstream of the nip and are each driven by their own controllable motor and which hold the paper web by negative pressure in a slip-free manner. As regards the suction rollers known hitherto, the supply of suction air to the roller casing is designed so that the suction surface extends over the entire width of the paper web and the entire angle around which the paper web is looped and which, if possible, amounts to at least 180°; the suction surface is therefore rectangular, as seen in a developed view.

Now it is usually desirable or necessary for the transport of a material web to stretch the material web in terms of width, that is to say transversely to the direction of transport. This is necessary particularly in web-fed printing machines, above all during intaglio printing, because, in this case, during the printing operation the paper web is deformed by high pressures which may amount to eighty tons per meter of paper-web width, in such a way that it has widened after it has left the printing zone. The paper web therefore tends to form longitudinal creases. For the further transport of the paper web, it is important to draw the paper web widthwise as soon as possible downstream of the printing zone, in order to remove these creases. So-called width-stretching rollers have been known hitherto for this purpose. On the one hand, width-stretching rollers of this type signify an additional installation in the transport system and, on the other hand, the use of special width-stretching rollers is not always possible. This applies particularly to web-fed printing machines which work by pilgrim-step operation. On account of the abovementioned high decelerations and accelerations of the paper web, the use of additional width-stretching rollers is impossible, since these would have to be decelerated and accelerated by the paper web; at the same time, the reactions on the paper web which are caused by the friction and inert mass of the width-stretching rollers would be highly disadvantageous for its positioning accuracy.

SUMMARY OF THE INVENTION

The object on which the invention is based is to provide draw rollers designed as suction rollers, in such a way that, without the need for additional width-stretching rollers, the material web is stretched widthwise when it passes the suction roller.

It is thereby ensured in a simple way that the edge regions of the material web, when it runs onto the suction roller, are not sucked up first and therefore have the possibility of running outwards as a result of the concave shape of the roller before they are then held by negative pressure. In particular, in the case of web-fed printing machines, there is the advantage that the width-stretching effect caused by the suction roller according to the invention is generated as close as possible downstream of the printing zone and without the use of machine parts burdened with additional masses. In general, the suction roller according to the invention can also be used in the case of a continuous uniform paper-web transport and for the transport of material webs other than paper webs.

BRIEF DESCRIPTION OF THE DRAWINGS

The invention is described in more detail by means of exemplary embodiments with reference to the drawings. In these.

DESCRIPTION OF THE PREFERRED EMBODIMENTS

Figure 1:
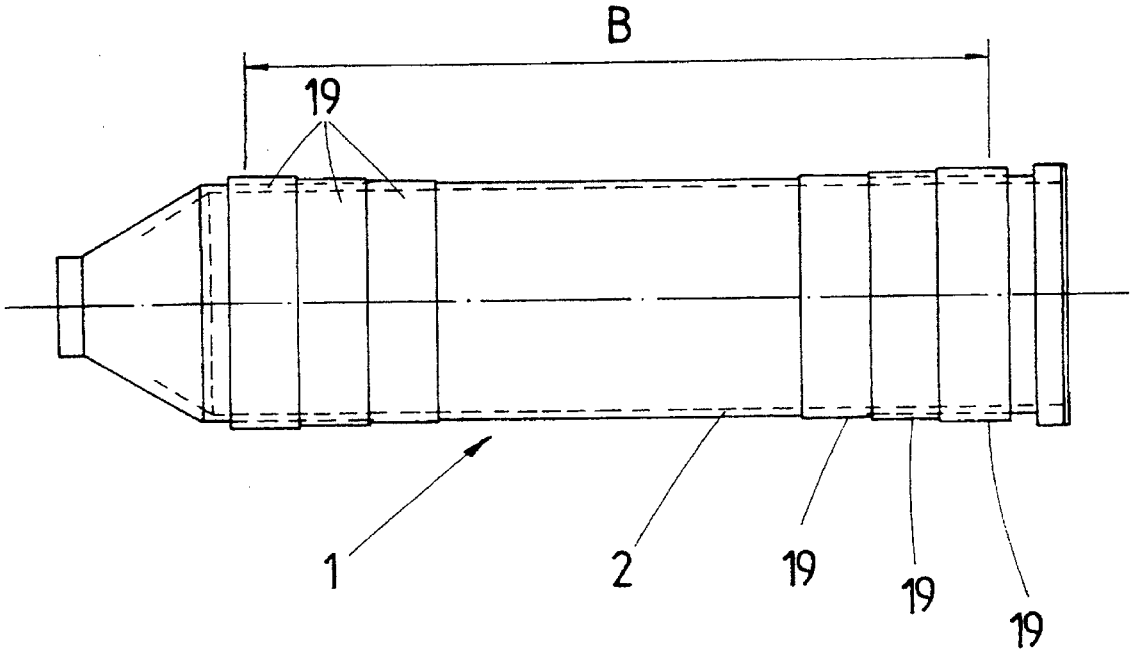
FIG. 1 shows a diagrammatic view of a first embodiment of a suction roller according to the invention.

As shown in FIGS. 1 to 4, a suction roller consists essentially of a stationary hollow roller core 1 made from metal and of a roller casing 2 which is rotatable on this roller core and which is provided on its circumference with uniformly distributed orifices 3 not shown in FIG. 1.

The roller core 1 is provided at one end with a bearing journal 4 and at the other end with an axially projecting hollow connection piece 5 for fastening the roller core to a machine frame and for connection to a negative-pressure source.

Figure 2:
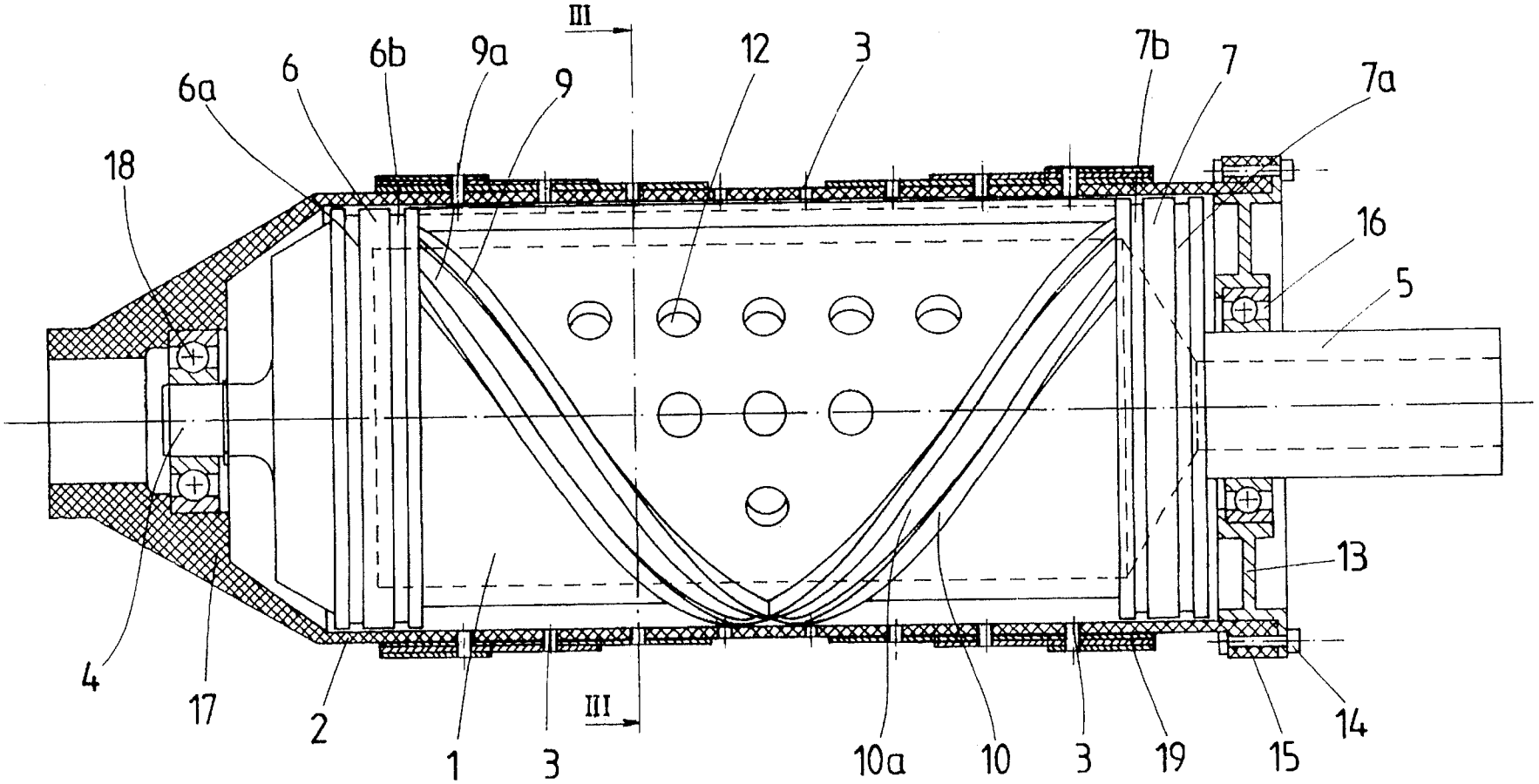
FIG. 2 shows an axial section through the suction roller according to FIG. 1 on an enlarged scale.
Figure 4:
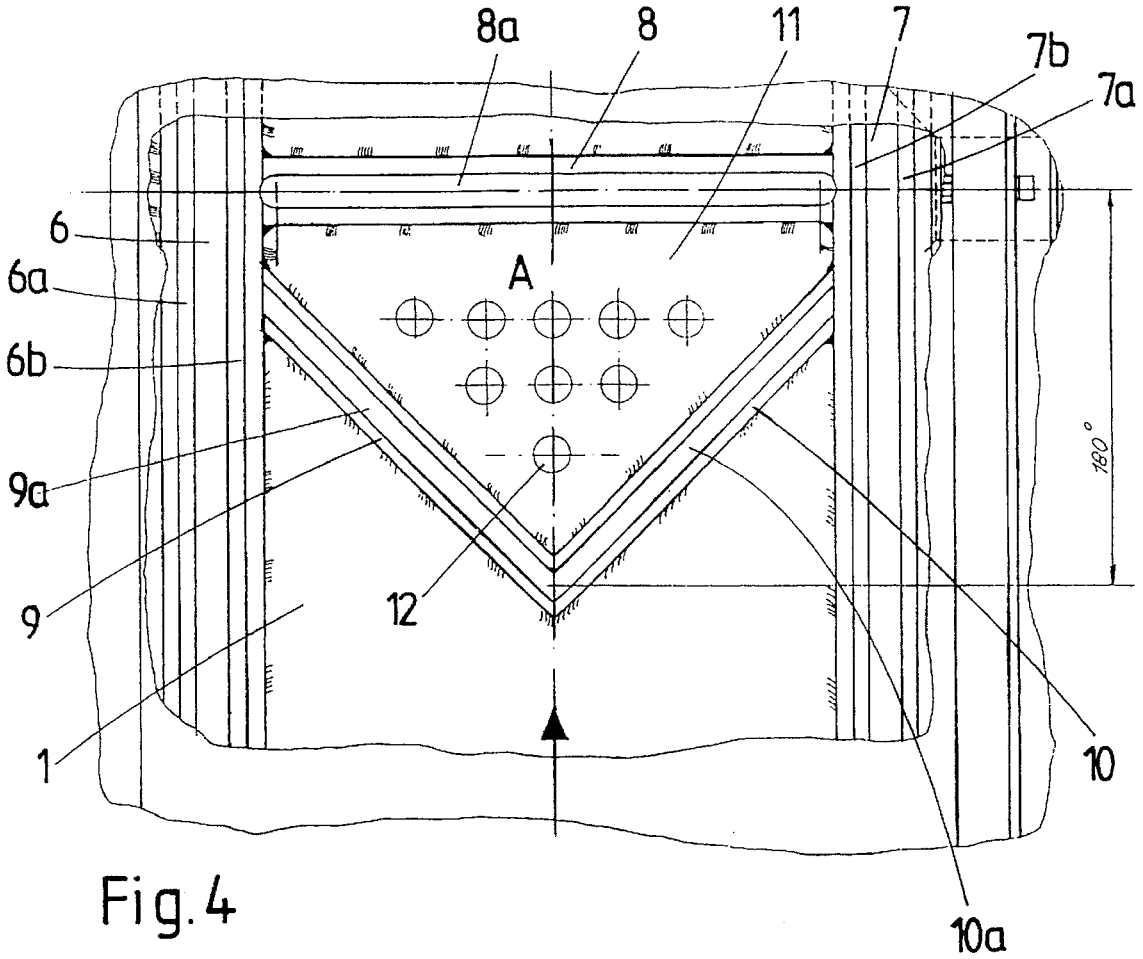
FIG. 4 shows a developed view of the suction roller along IV—IV according to FIG. 3.
Figure 3:
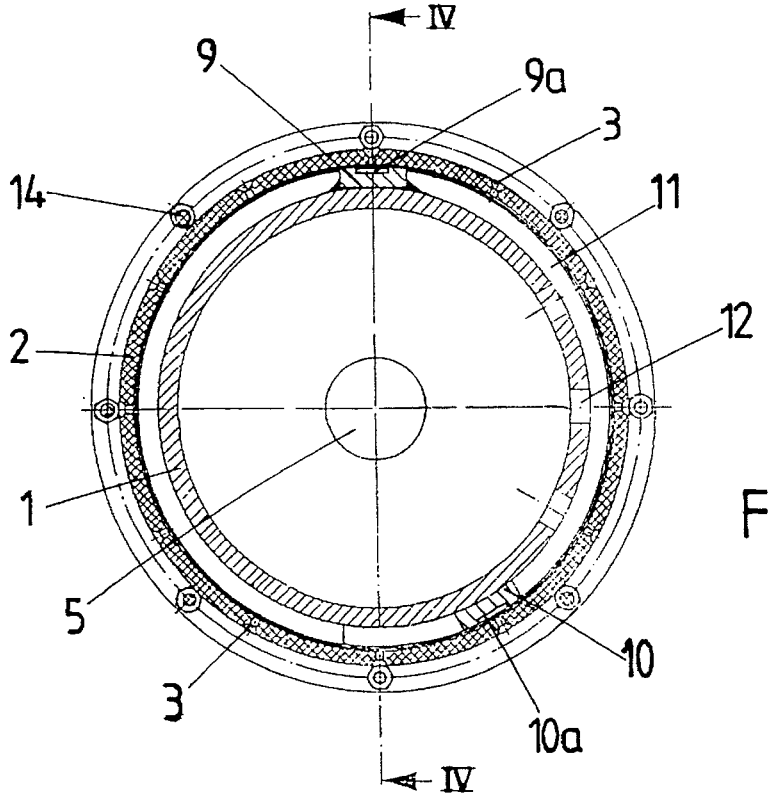
FIG. 3 shows a radial section along III—III according to FIG. 2.

The outer circumference of the roller casing is designed so that, starting from the roller center, its outside diameter increases continuously or in small steps towards both sides, so that the roller casing is somewhat concavely curved in the transverse direction, that is to say perpendicularly to the direction of transport of the material web. In the example according to FIGS. 1 to 4, this design can be achieved, in the case of a roller casing made initially cylindrical, in that successive material strips 19 of differing width are glued to its two end regions symmetrically to the center. The lowest strip has the largest width and each subsequent strip has a smaller width than that lying under it. The edges of all the strips located at the roller ends lying above one another, as shown in FIGS. 1 and 2. In this way, the effective outside diameter of the roller casing 2, starting from the center, increases in steps towards both sides and thus forms a concave surface, as seen in a direction oriented parallel to the roller axis. The orifices 3 of course also pass through the strips 19.

Fastened to the circumference of the hollow roller core 1 are radially outward-projecting walls 6, 7, 8, 9 and 10 which between the circumference of the roller core 1 and the roller casing 2, delimit a wedge-shaped suction chamber 11. These walls consist of two parallel annular walls 6 and 7 at both ends of the roller core 1, of a transverse wall 8 connecting the two annular walls 6 and 7 and of two walls 9 and 10 which extend obliquely relative to the circumferential direction. Walls 9 and 10 start from the inside of the annular walls 6 and 7 at a short distance from the transverse wall 8 and extend symmetrically towards the center of the roller core where they butt against one another, as shown in FIG. 2 and particularly in the developed view according to FIG. 4. These walls 9 and 10 extend helically on the circumference of the roller core 1, the transverse wall 8 and the portions of the annular walls 6 and 7 between the transverse wall 8 and the wall 9, on the one hand, and the wall 10. These walls 9 and 10 also on the other hand, define a wedge-shaped suction chamber 11, the tip of which is directed opposite to the direction of rotation of the roller casing, according to the arrow in FIG. 4, and therefore opposite to the direction of transport of the material web. In the region of this suction chamber 11, the circumferential wall of the roller core 1 is provided with relatively large passage orifices 12 which connect the suction chamber to the interior of the hollow roller core and, via the hollow connection piece 5, to an external negative-pressure source.

In the example under consideration, the radially outer end faces of said walls 6 to 10 are provided with shallow grooves. Specifically the end faces of the annular walls 6 and 7 are provided with two annular grooves **6*a*, 6*b* and 7*a*, 7*b* each, the end face of the transverse wall 8 with a groove 8*a* and the end faces of the walls 9 and 10 with a groove 9*a* and 10*a***. Sealing material can, if required, be inserted into these grooves.

At the end of the roller casing 2 located on the same side as the hollow connection piece 5, a flanged part 13 is fastened by means of screws 14 to an annular flange 15 formed on the roller casing. Flanged part 13 is rotatably mounted by means of a ball bearing 16 on the hollow connection piece 5 which is fastened to the annular wall 7. At the other end, the roller casing 2 forms a conically tapering connecting flange 17 which is rotatably mounted by means of a ball bearing 18 on the bearing journal 4 of the roller core 1. Flange 17 serves for the direct fastening of the roller casing to the rotor shaft of a drive motor driving the suction roller. The roller casing 2 preferably consists of a light-weight plastic, particularly of plastic-impregnated carbon fibers, so that it has as low a weight as possible.

The arrangement is such that, between the inner circumference of the roller casing 2 and the radially outer end faces of said walls 6 to 10 about which the roller casing rotates, there are provided only very narrow gaps which oppose such high resistance to a passage of air. Without the insertion of any particular sealing material, these gaps are sufficiently leak-proof to maintain the necessary negative pressure within the suction chamber 11 when the latter is connected to a negative-pressure source via the passage orifices 12 and the hollow connection piece 5. If appropriate, suitable sealing material can also be inserted into said grooves **6*a*, 6*b*, 7*a*, 7*b*, 8*a*, 9*a* and 10*a***.

The material web loops round the suction roller 1 along a circumferential portion which preferably amounts to 180°. Located within this circumferential portion is the suction chamber 11 which therefore extends between the transverse wall 8 and the tip of the wedge over an angle of approximately 180° suction chamber 11 thus defines a wedge-shaped suction surface in that region of the roller casing 2 provided with orifices 3 which is located above said suction chamber 11.

The material web, when it runs through the looped-round portion of the suction roller, tends to run to the highest point, with the result that the web edges are drawn outwards on account of the concave design of the roller casing 2 and on account of the wedge shape of the suction surface. Because of this wedge shape of the suction surface, of course, the material web, when it runs onto the suction roller, is not immediately retained in a slip-free manner over its entire width B, but only in the center. Accordingly, the edge regions of the material web initially remain free and thus, in view of the concave shape of the roller casing, can run outwards where they are then held successively by negative pressure. To achieve this width-stretching effect, it is therefore essential that the suction surface on the roller casing designed concavely transversely to the direction of transport commences at the start of looping in the center, extends obliquely outwards on both sides with an increasing looping angle and assumes the entire width B of the material web at the end of the looping. The looping angle can also have a size different from 180° and, in particular, may be larger than this angle.

Instead of the strips 19 shown in FIG. 1, which lie above one another and which consist, for example, of paper or coated paper, strips of differing thickness glued on next to one another can also be provided, the strip thickness decreasing from the roller ends towards the center.

Figure 5:
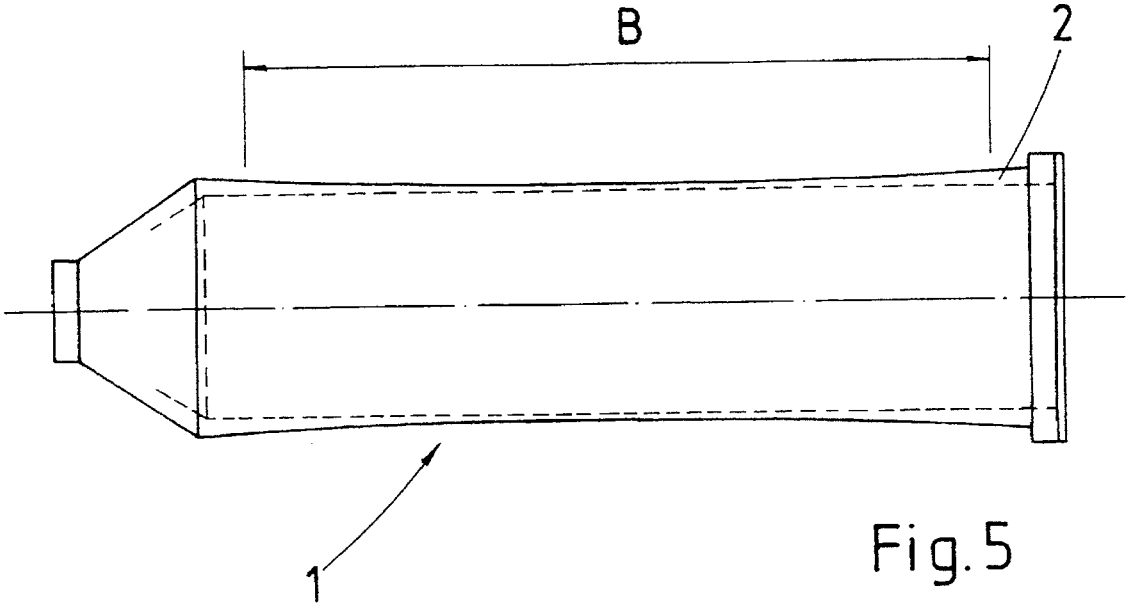
FIG. 5 shows a diagrammatic representation of a second embodiment of a suction roller according to the invention.

In the example according to FIG. 5, in which the roller core has exactly the same design as in the example according to FIGS. 1 to 4, the suction roller 1 has a roller casing 20. This casing 20 is provided with a cylindrical inside diameter and with an outer circumference which is curved slightly concavely, as seen parallel to the axis, and which has been produced by a corresponding shaping of the roller casing. The amount of concavity depends on the type of material web and is adapted to this.

The suction roller according to the invention is not restricted to the above-described constructive design of the roller core and of the roller casing, but embraces numerous other alternative versions, by means of which a suction-air supply generating on the roller casing an essentially wedge-shaped suction surface, as described, is obtained within the suction roller.

We claim:

1. A draw roller in the form of a suction roller having an axis for the transport of a material web, the material web looping round the suction roller along a specific circumferential portion having a start and an end, and the suction roller consisting of a stationary roller core (1), of a roller casing having an outer circumferential and an inner circumference and being rotatable about the core having a direction of rotation and having orifices (3) distributed over the casing outer circumference and of a suction-air supply which is provided on the roller core and can be connected to a negative-pressure source and which opens out on the inner circumference of the roller casing (2), the suction-air supply is designed in such a way that the region of the casing orifices (3) which is subject to negative pressure defines a stationary suction surface which is located within the circumferential portion around which the material web is looped, the roller casing (2) having a center and sides and an outside diameter increasing from the center towards both sides, and wherein said suction surface has a wedge-shaped form having a wedge tip, the wedge tip being directed opposite to the direction of rotation of the roller casing (21) and being located at the start of said circumferential portion in the roller casing center, and the suction surface widening obliquely outwards on both sides with an increasing looping angle and, at the end of the circumferential portion, having a width corresponding to the total width B of the material web.

2. The draw roller as claimed in claim 1, wherein there is a hollow roller cord (1) having a circumference, interior and circumferential wall and with radially outward-directed walls (6, 7, 8, 9, 10) which, between the circumference of the roller core (1) and the roller casing (2), delimit a wedge-shaped suction chamber (11) which can be connected to an external negative-pressure source via passage orifices (12) in the circumferential wall of the roller core (1) and via the interior of this roller core and which defines the wedge-shaped suction surface on the roller casing (2).

3. The draw roller as claimed in claim 1, wherein the roller casing (2) is made cylindrical and material strips (19) are fastened to the roller casing (2) in such a way that the roller casing outside diameter increases in steps from the center towards both sides.

4. The draw roller as claimed in claim 3, wherein successive material strips (19) having end regions and edges and being of differing width are glued to the two end regions symmetrically relative to the center, the lowest strip having the largest width and each subsequent strip has a smaller width than that lying under it, those edges of all the strips located at the roller casing sides lying above one another.

5. The draw roller as claimed in claim 1, wherein the roller casing (20) has a slightly concavely curved outer circumference, in the direction parallel to the roller axis.

* * * * *